US010697463B2

(12) United States Patent
Morie et al.

(10) Patent No.: US 10,697,463 B2
(45) Date of Patent: Jun. 30, 2020

(54) JET PROPULSION DEVICE

(71) Applicant: YAMAHA HATSUDOKI KABUSHIKI KAISHA, Iwata-shi, Shizuoka (JP)

(72) Inventors: Atsushi Morie, Shizuoka (JP); Mitsuyoshi Nakamura, Shizuoka (JP); Minoru Sato, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 105 days.

(21) Appl. No.: 16/196,079

(22) Filed: Nov. 20, 2018

(65) Prior Publication Data

US 2019/0345951 A1 Nov. 14, 2019

(30) Foreign Application Priority Data

May 8, 2018 (JP) ..... 2018-089630

(51) Int. Cl.

| | |
|---|---|
| ***F04D 29/00*** | (2006.01) |
| ***B63H 11/02*** | (2006.01) |
| ***F04D 3/00*** | (2006.01) |
| ***F04D 29/52*** | (2006.01) |
| ***F04D 29/08*** | (2006.01) |

(52) U.S. Cl.
CPC ..... *F04D 29/086* (2013.01); *B63H 11/02* (2013.01); *F04D 3/005* (2013.01); *F04D 29/528* (2013.01)

(58) Field of Classification Search
CPC ..... F04D 3/005; F04D 29/086; F04D 29/528; B63H 11/02
See application file for complete search history.

(56) References Cited

U.S. PATENT DOCUMENTS

| | | | | |
|---|---|---|---|---|
| 2,312,848 | A * | 3/1943 | Pezzillo | F04D 13/0646 417/356 |
| 5,490,768 | A * | 2/1996 | Veronesi | B63H 1/16 417/356 |
| 6,837,757 | B2 * | 1/2005 | Van Dine | B63H 23/24 310/87 |
| 8,840,378 | B2 * | 9/2014 | Tanaka | B63H 1/14 417/356 |
| 8,911,271 | B2 * | 12/2014 | Shibayama | B63H 11/04 440/38 |
| 2003/0013356 | A1 * | 1/2003 | Burns | F02K 1/36 440/38 |
| 2003/0064639 | A1 | 4/2003 | Matsuda et al. | |

FOREIGN PATENT DOCUMENTS

JP 2003-112688 A 4/2003

* cited by examiner

*Primary Examiner* — Igor Kershteyn
(74) *Attorney, Agent, or Firm* — Keating and Bennett, LLP

(57) ABSTRACT

A jet propulsion device includes an impeller housing, an impeller, a sleeve, a first ring-shaped elastic body, and a second ring-shaped elastic body. The first ring-shaped elastic body is disposed between the impeller housing and the sleeve, and is located between a first end and a middle of the sleeve in an axial direction of the sleeve. The second ring-shaped elastic body is disposed between the impeller housing and the sleeve, and is located between a second end and the middle of the sleeve in the axial direction of the sleeve.

18 Claims, 8 Drawing Sheets

JET PROPULSION DEVICE

CROSS REFERENCE TO RELATED APPLICATIONS

This application claims the benefit of priority to Japanese Patent Application No. 2018-089630 filed on May 8, 2018. The entire contents of this application are hereby incorporated herein by reference.

BACKGROUND OF THE INVENTION

1. Field of the Invention

The present invention relates to a jet propulsion device.

2. Description of the Related Art

A jet propulsion device is driven by an engine and generates a thrust by sucking water through a suction port and spouting the sucked in water through a jet spout. For example, a jet propulsion device described in Japan Laid-open Patent Application Publication No. 2003-112688 includes an impeller housing, a sleeve and an impeller. The sleeve is fixed to the inner peripheral surface of the impeller housing by press-fitting. The impeller is disposed inside the sleeve, and is driven and rotated by the engine.

An impeller with high stiffness is driven and rotated inside the sleeve. Hence, when deformed, the sleeve possibly contacts the impeller. Additionally, the sleeve is press-fitted to the impeller housing. Hence, removal of the sleeve from the impeller housing is not easy, and replacement of the sleeve cannot be easily made even when the sleeve is worn out by abrasion.

SUMMARY OF THE INVENTION

Preferred embodiments of the present invention prevent sleeves from being deformed and contacting impellers in jet propulsion devices, and simultaneously, enhance maintenance performance of the jet propulsion devices.

A jet propulsion device according to a preferred embodiment of the present invention generates a thrust by spouting water when driven by an engine, and includes an impeller housing, an impeller, a sleeve, a first ring-shaped elastic body, and a second ring-shaped elastic body. The impeller is disposed inside the impeller housing, and is driven and rotated by the engine. The sleeve is disposed between the impeller housing and the impeller. The sleeve includes a first end and a second end. The first end is one end of the sleeve in an axial direction of the sleeve. The second end is the other end of the sleeve in the axial direction of the sleeve. The first ring-shaped elastic body is disposed between the impeller housing and the sleeve, and is located between the first end and a middle of the sleeve in the axial direction. The second ring-shaped elastic body is disposed between the impeller housing and the sleeve, and is located between the second end and the middle of the sleeve in the axial direction.

In a jet propulsion device according to a preferred embodiment of the present invention, the sleeve is retained by the first and second ring-shaped elastic bodies in the impeller housing. As a result, even when the sleeve is deformed, the first and second ring-shaped elastic bodies are able to follow the deformation of the sleeve. Thus, the sleeve is prevented from being deformed and contacting the impeller. Additionally, the sleeve is easily detached from the impeller housing in comparison with a configuration in which the sleeve is press-fitted to the impeller housing. Therefore, maintenance performance is enhanced.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
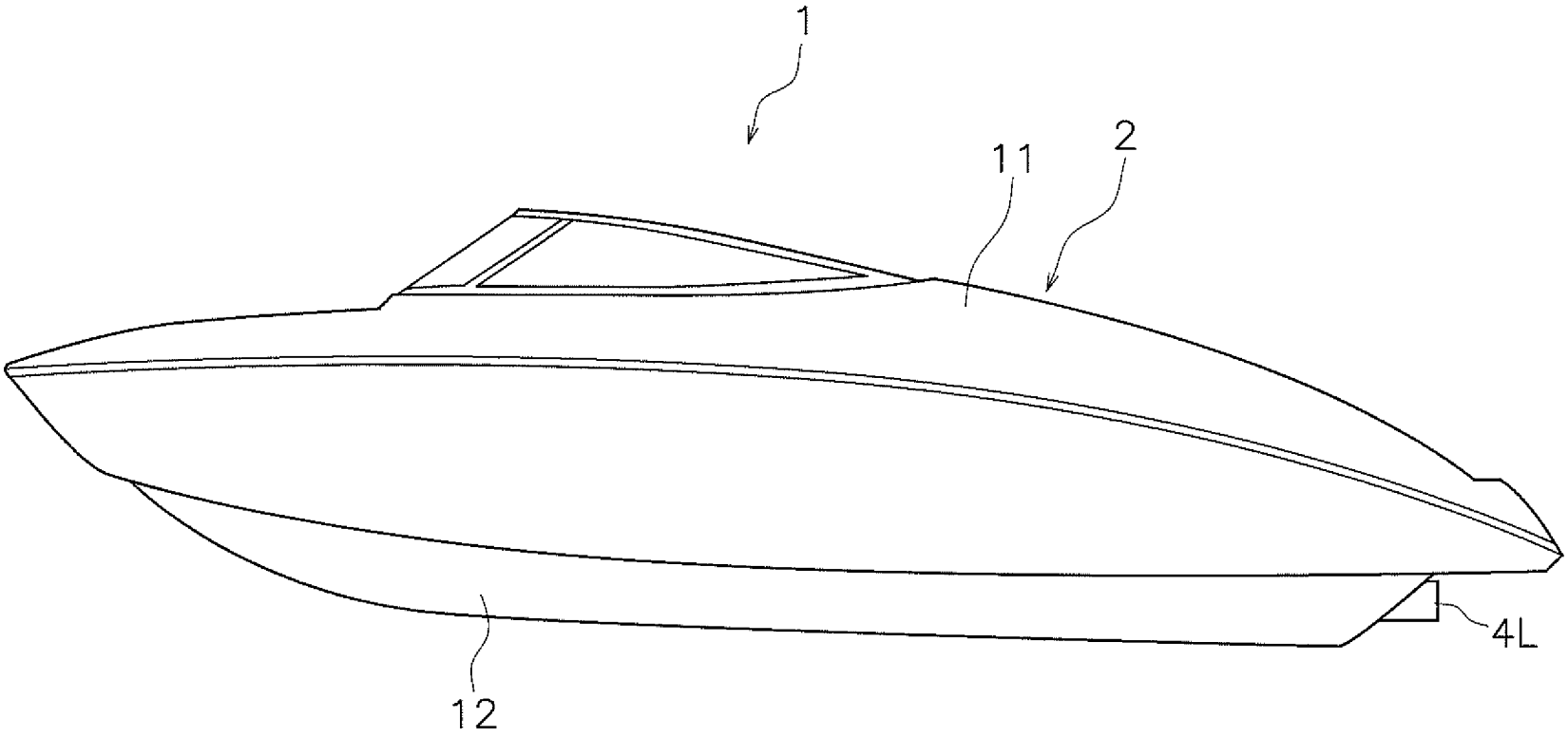
FIG. 1 is a side view of a watercraft including a jet propulsion device according to a preferred embodiment of the present invention.
Figure 2:
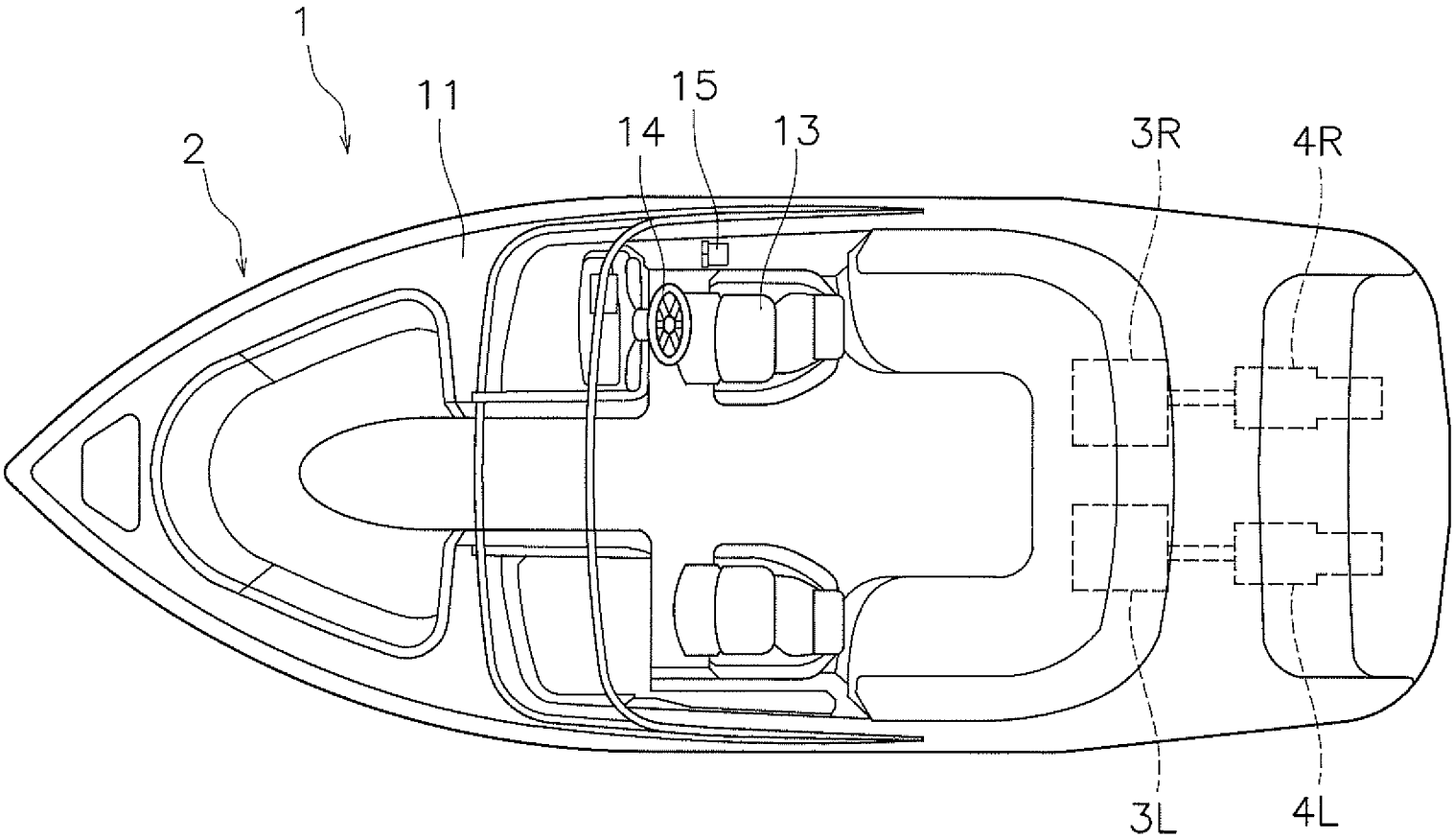
FIG. 2 is a top view of the watercraft.

Jet propulsion devices according to preferred embodiments of the present invention will be hereinafter explained with reference to drawings. FIG. 1 is a side view of a watercraft 1 to which a jet propulsion device according to a preferred embodiment of the present invention is mounted. FIG. 2 is a top view of the watercraft 1. In the present preferred embodiment, the watercraft 1 is a jet propulsion watercraft, which is a type of watercraft called a jetboat or a sport boat.

The watercraft 1 includes a vessel body 2, engines 3L and 3R, and jet propulsion devices 4L and 4R. The vessel body 2 includes a deck 11 and a hull 12. The hull 12 is disposed below the deck 11. An operator seat 13 is disposed on the deck 11. The operator seat 13 is provided with a steering wheel 14 to steer the watercraft 1. Additionally, the operator seat 13 is provided with an operating lever 15 to switch between forward movement and rearward movement of the watercraft 1 and regulate the vessel velocity of the watercraft 1.

The engines 3L and 3R are accommodated in the vessel body 2. The engine 3L is connected to the jet propulsion device 4L. The engine 3R is connected to the jet propulsion device 4R. The jet propulsion devices 4L, 4R are driven by the engines 3L, 3R so as to suck in and spout water to the surroundings of the vessel body 2. Accordingly, each jet propulsion device 4L, 4R generates a thrust to move the vessel body 2.

Figure 3:
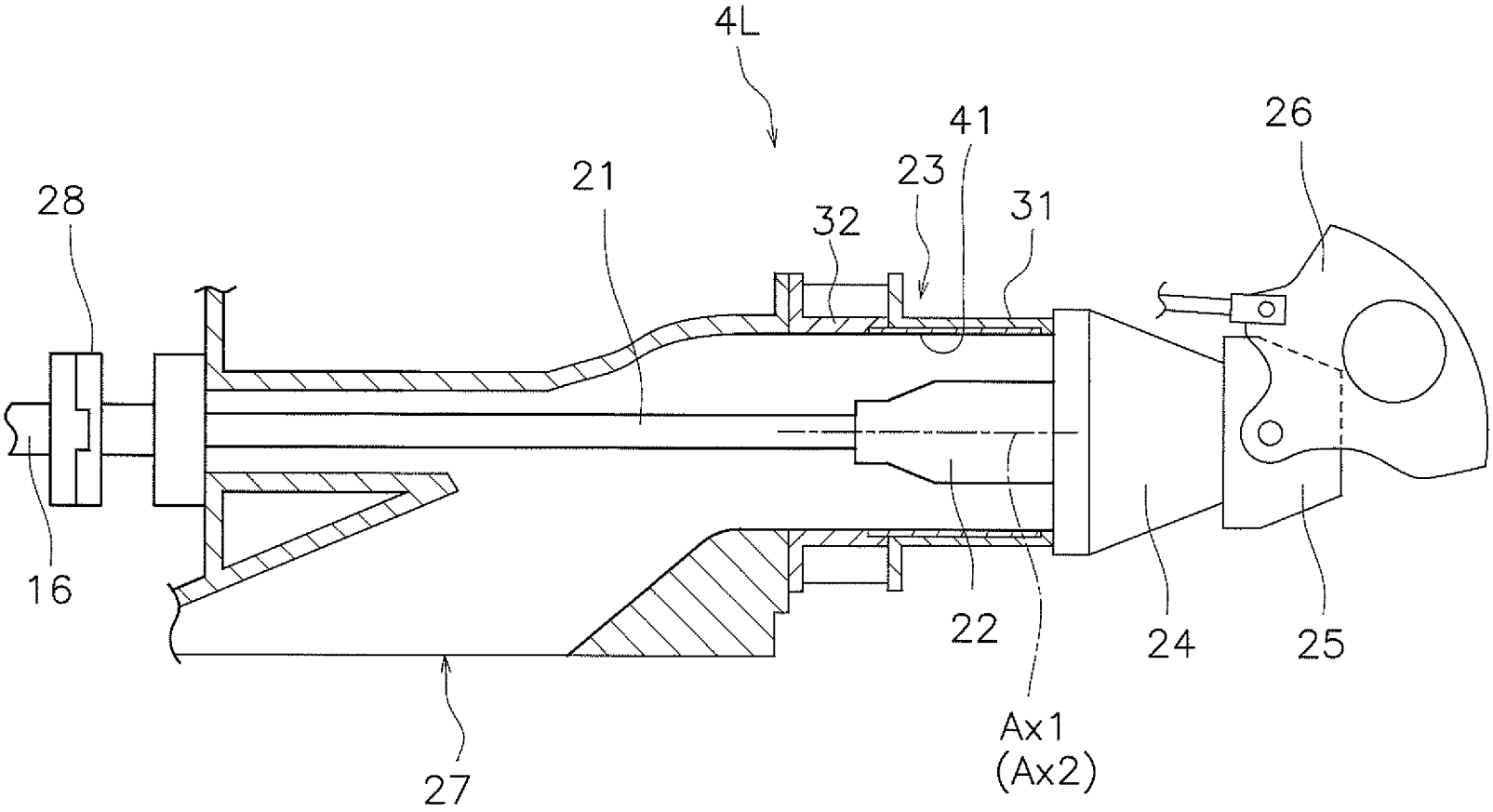
FIG. 3 is a cross-sectional side view of a jet propulsion device according to a preferred embodiment of the present invention.

FIG. 3 is a side view of the jet propulsion device 4L. It should be noted that FIG. 3 shows a portion of the jet propulsion device 4L in a cross-sectional representation. As shown in FIG. 3, the jet propulsion device 4L includes an impeller shaft 21, an impeller 22, an impeller housing 23, a nozzle 24, a deflector 25, and a reverse bucket 26.

The impeller shaft 21 extends in a back-and-forth direction. The front portion of the impeller shaft 21 is connected to an output shaft 16 of an engine 3 through a coupling 28. The impeller 22 is attached to the rear portion of the impeller shaft 21. The impeller 22 is disposed inside the impeller housing 23. The impeller 22 is rotated together with the impeller shaft 21 in order to draw in water through a suction port 27. The impeller 22 rearwardly spouts the drawn in water through the nozzle 24.

The deflector 25 is disposed behind the nozzle 24. The reverse bucket 26 is disposed behind the deflector 25. The deflector 25 turns the direction of the water spouted through the nozzle 24 in a right-and-left direction.

The reverse bucket 26 is switchable between a forward moving position and a rearward moving position. When the position of the reverse bucket 26 is switched between the forward moving position and the rearward moving position, the direction of the water spouted through the nozzle 24 is changed. Movement of the watercraft 1 is thus switched between forward movement and rearward movement. Although not shown in the drawings, the jet propulsion device 4R preferably has a similar structure to the jet propulsion device 4L.

Figure 4:
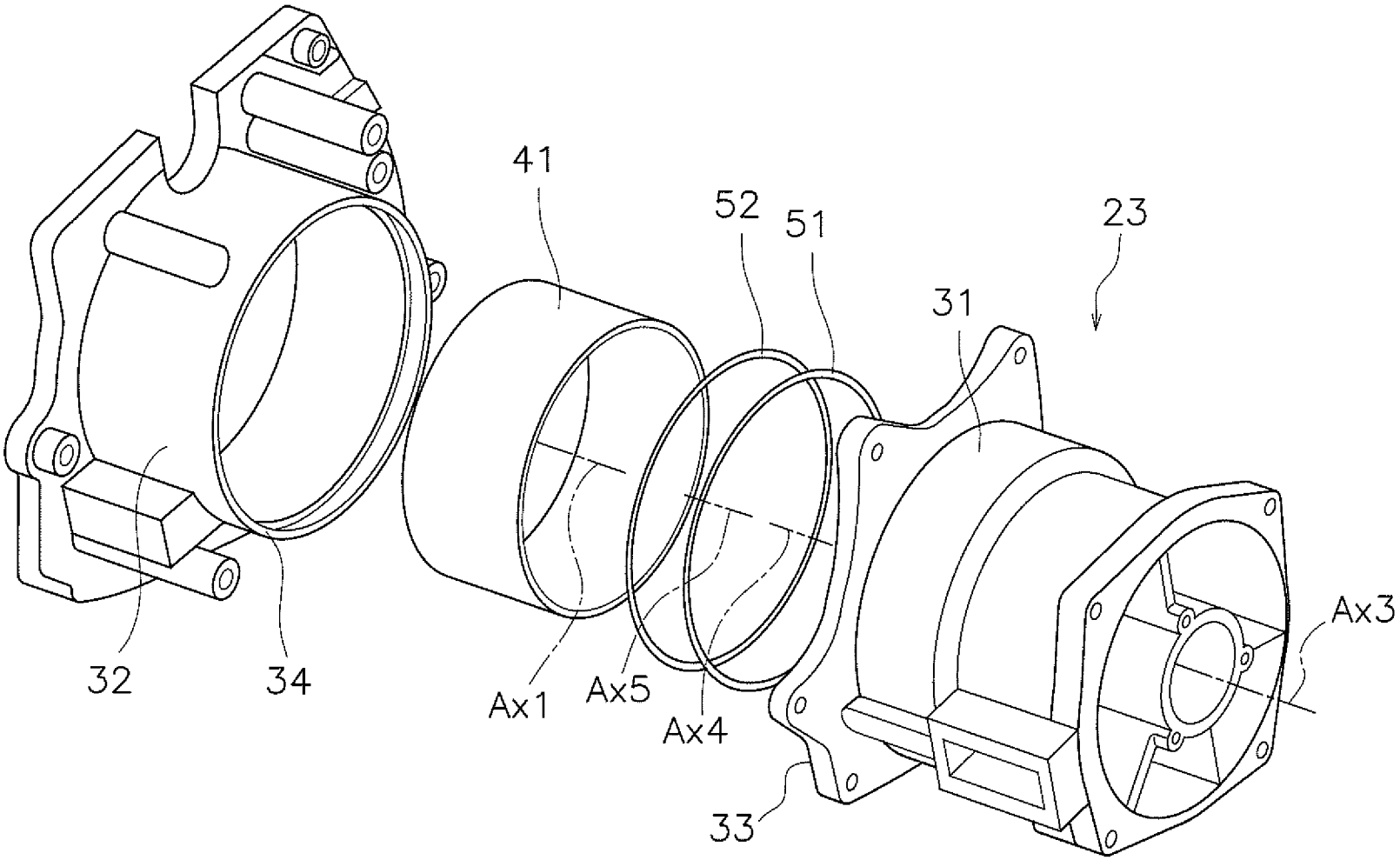
FIG. 4 is an exploded perspective view of a portion of a jet propulsion device according to a preferred embodiment of the present invention.
Figure 5:
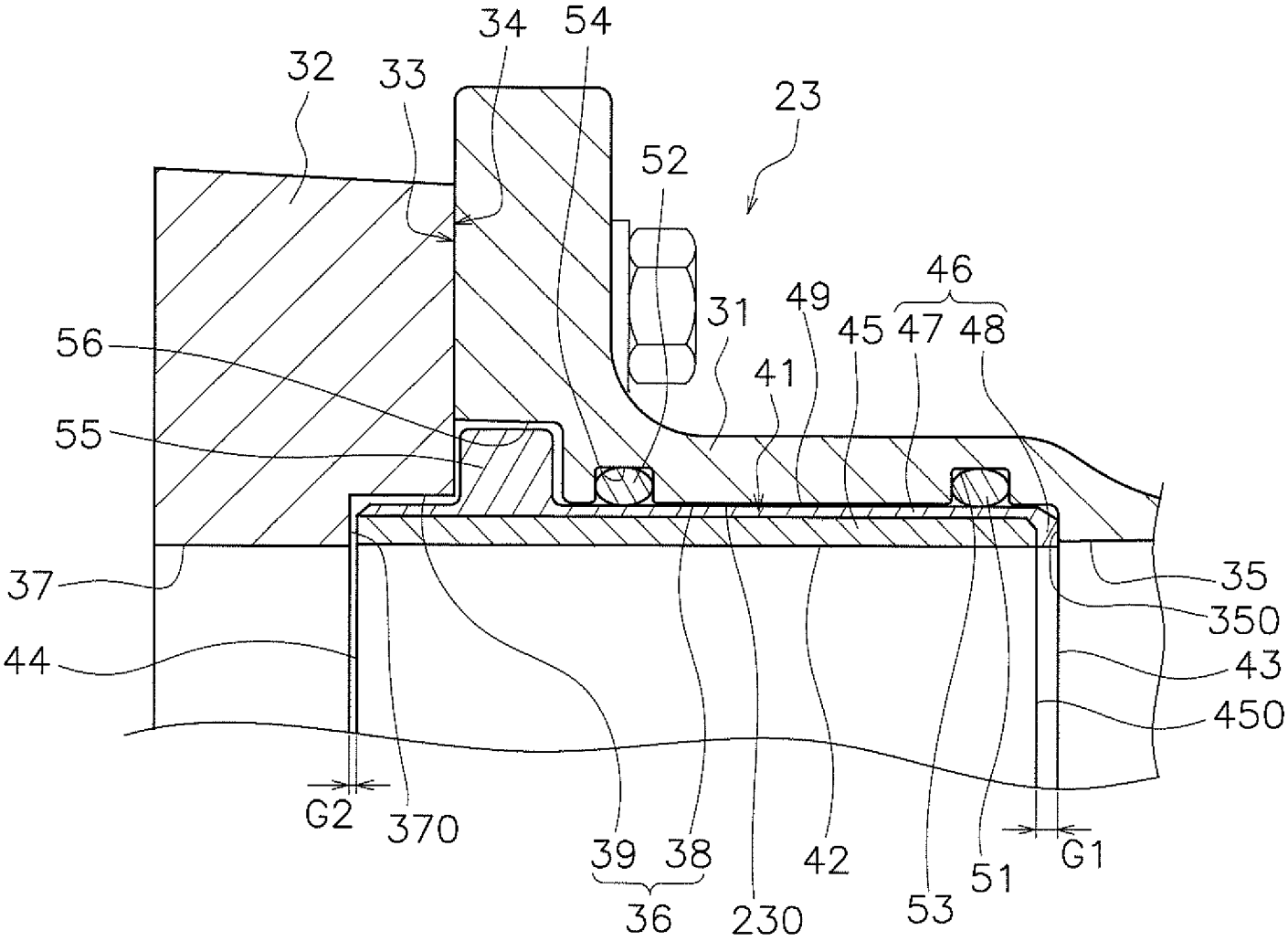
FIG. 5 is a cross-sectional side view of a portion of a jet propulsion device according to a preferred embodiment of the present invention.

FIG. 4 is an exploded perspective view of a portion of the jet propulsion device 4L. FIG. 5 is a cross-sectional view of the portion of the jet propulsion device 4L. As shown in FIGS. 4 and 5, the impeller housing 23 includes a first housing portion 31 and a second housing portion 32. The nozzle 24 is attached to the first housing portion 31. The second housing portion 32 is attached to the vessel body 2. The first and second housing portions 31 and 32 are separate from each other. The first and second housing portions 31 and 32 are fixed to each other by elements such as bolts, for example. Accordingly, an end 33 of the first housing portion 31 is connected to an end 34 of the second housing portion 32.

The jet propulsion device 4L includes a sleeve 41. The sleeve 41 is disposed between the impeller housing 23 and the impeller 22. The sleeve 41 has a tubular or substantially tubular shape. The impeller 22 is disposed inside the sleeve 41. As shown in FIG. 3, a center axis Ax1 of the sleeve 41 is parallel or substantially parallel to a center axis Ax2 of the impeller 22. Preferably, the center axis Ax1 of the sleeve 41 is concentric with the center axis Ax2 of the impeller 22.

The sleeve 41 is disposed inside the impeller housing 23. As shown in FIG. 4, the center axis Ax1 of the sleeve 41 and a center axis Ax3 of the impeller 22 are parallel or substantially parallel to each other. Preferably, the center axis Ax1 of the sleeve 41 is concentric with the center axis Ax3 of the impeller 22.

As shown in FIG. 5, the inner peripheral surface of the impeller housing 23 includes a first inner peripheral surface 35, a sleeve accommodation portion 36, and a second inner peripheral surface 37. The inner diameter of the sleeve accommodation portion 36 is larger than that of the first inner peripheral surface 35. The inner diameter of the sleeve accommodation portion 36 is larger than that of the second inner peripheral surface 37. The sleeve 41 is disposed in the sleeve accommodation portion 36. An inner peripheral surface 42 of the sleeve 41 is flush or substantially flush with the first inner peripheral surface 35. The inner peripheral surface 42 of the sleeve 41 is flush or substantially flush with the second inner peripheral surface 37.

The first inner peripheral surface 35 is included in the first housing portion 31. The second inner peripheral surface 37 is included in the second housing portion 32. The sleeve accommodation portion 36 includes a first accommodation portion 38 and a second accommodation portion 39. The first accommodation portion 38 is included in the first housing portion 31. The second accommodation portion 39 is included in the second housing portion 32.

The sleeve 41 includes a first end 43 and a second end 44. The first end 43 is one end of the sleeve 41 in the axial direction of the sleeve 41, and the second end 44 is the other end of the sleeve 41 in the axial direction of the sleeve 41. The first end 43 is disposed in the first accommodation portion 38. The second end 44 is disposed in the second accommodation portion 39.

The sleeve 41 includes a metallic layer 45 and an insulating layer 46. The metallic layer 45 defines a portion of the inner peripheral surface 42 of the sleeve 41. The metallic layer 45 is made of a metal that is different from a metal from which the impeller housing 23 is made. For example, the impeller housing 23 may be made of aluminum, whereas the metallic layer 45 of the sleeve 41 may be made of stainless steel, for example. However, the impeller housing 23 may be made of a metal other than aluminum. The sleeve 41 may be made of a metal other than stainless steel.

The insulating layer 46 is disposed on the outer peripheral side of the metallic layer 45. The insulating layer 46 is coated on the outer peripheral side of the metallic layer 45. The insulating layer 46 is made of resin, for example. The insulating layer 46 is made of a resin such as polybutylene terephthalate (PBT), for example. However, the insulating layer 46 may be made of a resin other than PBT.

The insulating layer 46 includes an outer peripheral portion 47 and an end cover portion 48. The outer peripheral portion 47 is provided on the outer peripheral side of the metallic layer 45, and covers the metallic layer 45 from the outer peripheral side. The end cover portion 48 covers an end 450 of the metallic layer 45 in the axial direction of the sleeve 41. The end cover portion 48 contacts a first step 350 provided between the sleeve accommodation portion 36 and the first inner peripheral surface 35. The end cover portion 48 is disposed between the end 450 and the first step 350. Therefore, the end 450 of the metallic layer 45 is not in contact with the first step 350, such that a gap G1 is provided between the end 450 and the first step 350 in the axial direction of the sleeve 41.

The insulating layer 46 is disposed not to cover the second end 44 in the axial direction of the sleeve 41. The second end 44 is opposed to a second step 370 provided between the sleeve accommodation portion 36 and the second inner peripheral surface 37. The sleeve accommodation portion 36 is longer than the metallic layer 45 of the sleeve 41 in the axial direction of the sleeve 41. Therefore, while the end cover portion 48 is in contact with the first step 350, the second end 44 is not in contact with the second step 370, such that a gap G2 is provided between the second end 44 and the second step 370 in the axial direction of the sleeve 41.

The jet propulsion device 4L includes a first ring-shaped elastic body 51 and a second ring-shaped elastic body 52. The first and second ring-shaped elastic bodies 51 and 52 are disposed between the impeller housing 23 and the sleeve 41. The first ring-shaped elastic body 51 is disposed between the first end 43 and the middle of the sleeve 41 in the axial direction. The second ring-shaped elastic body 52 is disposed between the second end 44 and the middle of the sleeve 41 in the axial direction. The first and second ring-shaped elastic bodies 51 and 52 preferably include O-rings, for example. The first and second ring-shaped elastic bodies 51 and 52 are preferably made of rubber, for example. For example, the first and second ring-shaped elastic bodies 51 and 52 may be made of nitrile rubber (NBR). However, the first and second ring-shaped elastic bodies 51 and 52 may be made of a material other than nitrile rubber.

As shown in FIG. 4, a center axis Ax4 of the first ring-shaped elastic body 51 and a center axis Ax5 of the second ring-shaped elastic body 52 are parallel or substantially parallel to the center axis Ax1 of the sleeve 41. Preferably, the center axis Ax4 of the first ring-shaped elastic body 51 and the center axis Ax5 of the second ring-shaped elastic body 52 are concentric with the center axis Ax1 of the sleeve 41. The inner peripheral surface of the first ring-shaped elastic body 51 and that of the second ring-shaped elastic body 52 are in contact with an outer peripheral surface 49 of the sleeve 41. The first and second ring-shaped elastic bodies 51 and 52 are in contact with an inner peripheral surface 230 of the impeller housing 23.

The inner peripheral surface 230 of the impeller housing 23 includes a first groove 53 and a second groove 54. The first and second grooves 53 and 54 are spaced apart from each other in the axial direction of the sleeve 41. The first groove 53 is located between the first end 43 and the middle of the sleeve 41 in the axial direction. The second groove 54 is located between the second end 44 and the middle of the sleeve 41 in the axial direction. The first ring-shaped elastic body 51 is disposed in the first groove 53. The second ring-shaped elastic body 52 is disposed in the second groove 54.

The first groove 53 is continuously provided on the inner peripheral surface 230 of the impeller housing 23 in the circumferential direction. The second groove 54 is continuously provided on the inner peripheral surface 230 of the impeller housing 23 in the circumferential direction. The first and second grooves 53 and 54 are provided on the inner peripheral surface of the first housing portion 31.

Figure 6:
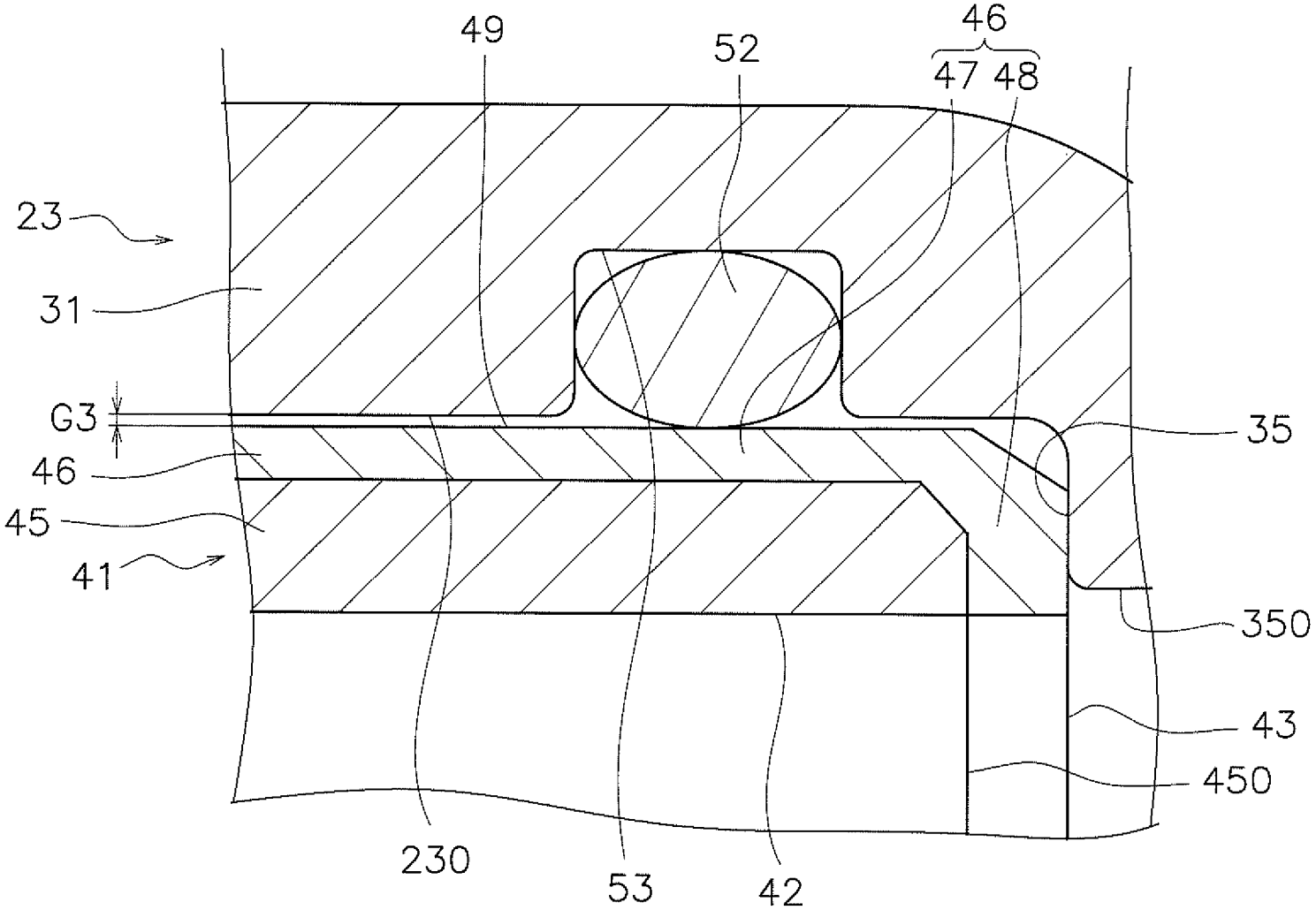
FIG. 6 is an enlarged cross-sectional view of an impeller housing and a sleeve.

The outer peripheral surface 49 of the sleeve 41 is pressed by the first and second ring-shaped elastic bodies 51 and 52 when the sleeve 41 is disposed between the impeller housing 23 and the impeller 22. FIG. 6 is an enlarged cross-sectional view of the sleeve 41 and the impeller housing 23. As shown in FIG. 6, the outer diameter of the sleeve 41 is smaller than the inner diameter of the sleeve accommodation portion 36 of the impeller housing 23. Therefore, the impeller housing 23 and the sleeve 41 are not in contact with each other, such that a gap G3 is provided between the inner peripheral surface 230 of the impeller housing 23 and the outer peripheral surface 49 of the sleeve 41 in the radial direction of the sleeve 41.

As shown in FIG. 5, the sleeve 41 includes a rotation restrictor 55. The rotation restrictor 55 protrudes radially outward from the outer peripheral surface 49 of the sleeve 41. The rotation restrictor 55 is located between the second end 44 and the second groove 54 in the axial direction of the sleeve 41. The rotation restrictor 55 is preferably made of resin, for example. The rotation restrictor 55 is preferably integral with the insulating layer 46.

The inner peripheral surface 230 of the impeller housing 23 includes a recess 56. The recess 56 has a shape that is recessed radially outward from the inner peripheral surface 230 of the impeller housing 23. The recess 56 is provided in the first accommodation portion 38. The recess 56 has a shape that is recessed from the end 33 of the first housing portion 31 in the axial direction. The rotation restrictor 55 is disposed in the recess 56. The recess 56 is locked onto the rotation restrictor 55. The sleeve 41 is restricted from rotating with respect to the impeller housing 23 in the circumferential direction of the sleeve 41 due to contact of the rotation restrictor 55 with the inner surface of the recess 56.

In the jet propulsion device 4L according to the present preferred embodiment, the sleeve 41 is retained by the first and second ring-shaped elastic bodies 51 and 52 in the impeller housing 23. Because of this, even when the sleeve 41 is deformed, the first and second ring-shaped elastic bodies 51 and 52 are able to follow the deformation of the sleeve 41. Thus, the sleeve 41 is prevented from being deformed and contacting the impeller 22.

Additionally, the sleeve 41 is pressed by the elastic forces of the first and second ring-shaped elastic bodies 51 and 52, and is thus fixed to the impeller housing 23. Therefore, the sleeve 41 is easily detached from the impeller housing 23 in comparison with a configuration in which the sleeve 41 is press-fitted to the impeller housing 23. Because of this, maintenance performance is enhanced.

When the impeller housing 23 and the metallic layer 45 of the sleeve 41 are made of different metals and contact each other, galvanic corrosion is likely to occur in the impeller housing 23. When galvanic corrosion proceeds in the impeller housing 23, the impeller housing 23 might be expanded due to oxidation, such that the position of the sleeve 41 is displaced radially inward. In this case, there is a concern that the sleeve 41 interferes with the impeller 22.

However, in the jet propulsion device 4L according to the present preferred embodiment, the insulating layer 46 made of resin is disposed on the outer peripheral surface 49 of the sleeve 41. Therefore, the metallic layer 45 of the sleeve 41 is prevented from contacting the inner peripheral surface 230 of the impeller housing 23. Accordingly, galvanic corrosion is prevented from occurring in the impeller housing 23.

In the jet propulsion device 4L according to the present preferred embodiment, the sleeve 41 is retained by the first and second ring-shaped elastic bodies 51 and 52 in the impeller housing 23. Therefore, the gap G3 is provided between the sleeve 41 and the impeller housing 23, such that the sleeve 41 and the impeller housing 23 are prevented from contacting each other. Accordingly, galvanic corrosion is prevented from occurring in the metallic layer 45 of the sleeve 41.

The sleeve 41 is retained in the impeller housing 23 by the elastic forces of the first and second ring-shaped elastic bodies 51 and 52. Therefore, the sleeve 41 is easily attached/detached to/from the impeller housing 23. Because of this, maintenance performance of the jet propulsion device 4L is enhanced.

Preferred embodiments of the present invention have been described above. However, the present invention is not limited to the above-described preferred embodiments, and a variety of changes can be made without departing from the gist of the present invention.

In the above-described preferred embodiments, the jet propulsion devices are preferably mounted to the jetboat. However, the jet propulsion devices may be mounted to another type of watercraft such as a PWC (Personal Watercraft) or so forth. The number of jet propulsion devices mounted to the watercraft is not limited two, and alternatively, may be one or may be three or more.

Figure 7:
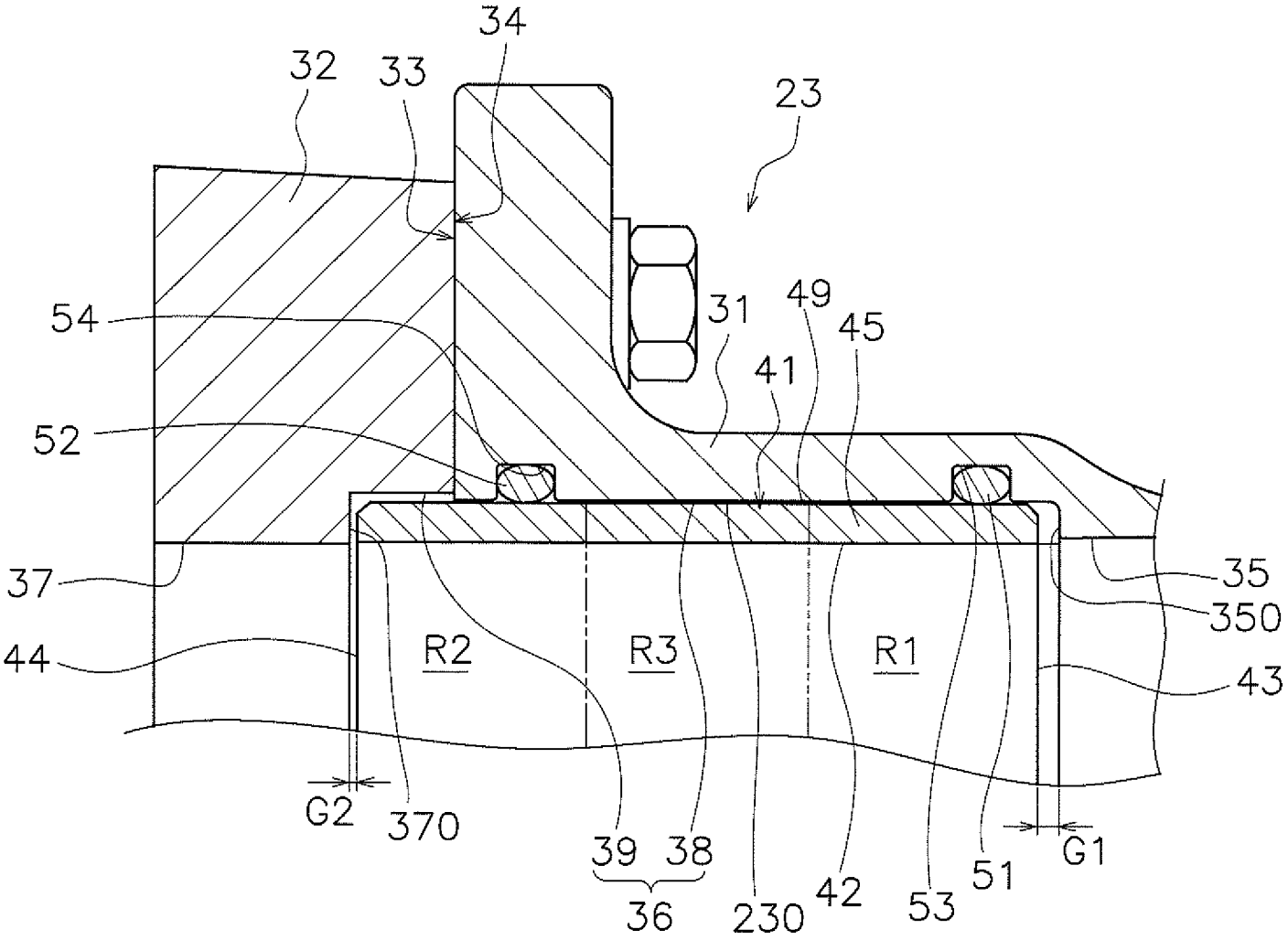
FIG. 7 is a cross-sectional side view of a portion of a jet propulsion device according to a first modified preferred embodiment of the present invention.

In the above-described preferred embodiments, the outer peripheral surface 49 of the sleeve 41 is preferably made of resin. However, the outer peripheral surface 49 of the sleeve 41 may be made of a metal that is different from a metal from which the impeller housing 23 is made. For example, FIG. 7 is a cross-sectional view of a portion of the jet propulsion device 4L according to a first modified preferred embodiment of the present invention. As shown in FIG. 7, the insulating layer 46 may be omitted in the sleeve 41.

The layouts of the first and second ring-shaped elastic bodies 51 and 52 may be changed. For example, as shown in FIG. 7, the sleeve 41 may include a first region R1, a second region R2, and a third region R3 aligned in the axial direction of the sleeve 41. The first, second, and third regions R1, R2 and R3 preferably equally or substantially equally trisect the sleeve 41 in the axial direction of the sleeve 41. The first region R1 includes the first end 43 of the sleeve 41, and the second region R2 includes the second end 44 of the sleeve 41. The third region R3 is located between the first region R1 and the second region R2 in the axial direction of the sleeve 41. The first ring-shaped elastic body 51 may be attached to the first region R1. The second ring-shaped elastic body 52 may be attached to the second region R2.

Figure 8:
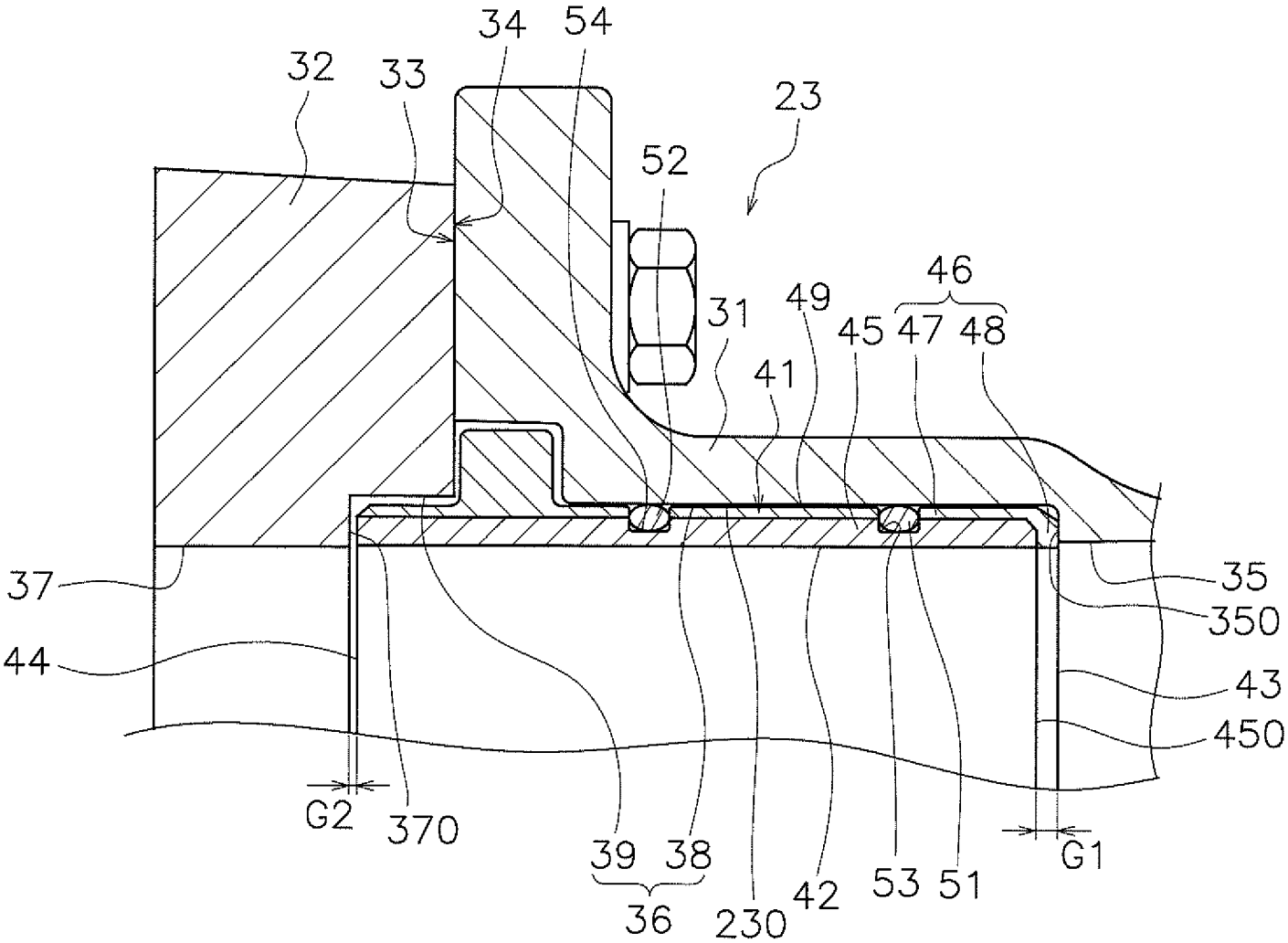
FIG. 8 is a cross-sectional side view of a portion of a jet propulsion device according to a second modified preferred embodiment of the present invention.

FIG. 8 is a cross-sectional view of a portion of the jet propulsion device 4L according to a second modified preferred embodiment of the present invention. As shown in FIG. 8, the outer peripheral surface 49 of the sleeve 41 may include the first groove 53 in which the first ring-shaped elastic body 51 is disposed and the second groove 54 in which the second ring-shaped elastic body 52 is disposed. The first groove 53 may be continuously provided on the inner peripheral surface 42 of the sleeve 41 in the circumferential direction. The second groove 54 may be continuously provided on the inner peripheral surface 42 of the sleeve 41 in the circumferential direction.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A jet propulsion device that generates a thrust by spouting water when driven by an engine, the jet propulsion device comprising:

an impeller housing;

an impeller disposed inside the impeller housing and that is driven and rotated by the engine;

a sleeve disposed between the impeller housing and the impeller, the sleeve including a first end and a second end at ends of the sleeve in an axial direction of the sleeve;

a first ring-shaped elastic body disposed between the impeller housing and the sleeve, the first ring-shaped elastic body being located between the first end and a middle of the sleeve in the axial direction; and a second ring-shaped elastic body disposed between the impeller housing and the sleeve, the second ring-shaped elastic body being located between the second end and the middle of the sleeve in the axial direction.

2. The jet propulsion device according to claim 1, wherein at least one of an inner peripheral surface of the impeller housing and an outer peripheral surface of the sleeve includes a first groove in which the first ring-shaped elastic body is disposed; and at least one of the inner peripheral surface of the impeller housing and the outer peripheral surface of the sleeve includes a second groove in which the second ring-shaped elastic body is disposed.

3. The jet propulsion device according to claim 2, wherein the first groove is continuous along the inner peripheral surface of the impeller housing in a circumferential direction; and the second groove is continuous along the inner peripheral surface of the impeller housing in the circumferential direction.

4. The jet propulsion device according to claim 2, wherein the first groove is continuous along the outer peripheral surface of the sleeve in a circumferential direction; and the second groove is continuous along the outer peripheral surface of the sleeve in the circumferential direction.

5. The jet propulsion device according to claim 1, wherein an inner peripheral surface of the impeller housing includes a sleeve accommodation portion that accommodates the sleeve;

the sleeve has an outer diameter that is smaller than an inner diameter of the sleeve accommodation portion; and a gap is provided between an inner peripheral surface of the sleeve accommodation portion and an outer peripheral surface of the sleeve in a radial direction of the sleeve.

6. The jet propulsion device according to claim 1, wherein the sleeve includes:

a metallic layer made of a metal that is different from a metal of the impeller housing; and an insulating layer disposed on an outer peripheral side of the metallic layer.

7. The jet propulsion device according to claim 6, wherein the metal of the impeller housing is aluminum; and the metal of the metallic layer of the sleeve is stainless steel.

8. The jet propulsion device according to claim 1, wherein the first ring-shaped elastic body and the second ring-shaped elastic body include O-rings.

9. The jet propulsion device according to claim 1, wherein the sleeve includes a rotation restrictor that restricts the sleeve from rotating in a circumferential direction with respect to the impeller housing.

10. The jet propulsion device according to claim 9, wherein the rotation restrictor protrudes from an outer peripheral surface of the sleeve; and an inner peripheral surface of the impeller housing includes a recess locked onto the rotation restrictor.

11. The jet propulsion device according to claim 10, wherein the sleeve is restricted from rotating with respect to the impeller housing due to contact of the rotation restrictor with an inner surface of the recess.

12. The jet propulsion device according to claim 1, wherein the sleeve includes an outer peripheral surface made of a metal that is different from a metal of the impeller housing;

the sleeve includes a first region, a second region, and a third region aligned in the axial direction of the sleeve and equally or substantially equally trisect the sleeve in the axial direction of the sleeve;

the first region includes the first end;

the second region includes the second end;

the third region is located between the first region and the second region in the axial direction of the sleeve;

the first ring-shaped elastic body is attached to the first region; and the second ring-shaped elastic body is attached to the second region.

13. The jet propulsion device according to claim 1, wherein the impeller is disposed inside the sleeve.

14. The jet propulsion device according to claim 1, wherein a center axis of the sleeve is parallel or substantially parallel to a center axis of the impeller.

15. The jet propulsion device according to claim 1, wherein an inner peripheral surface of the first ring-shaped elastic body and an inner peripheral surface of the second ring-shaped elastic body contact an outer peripheral surface of the sleeve.

16. The jet propulsion device according to claim 1, wherein a center axis of the first ring-shaped elastic body and a center axis of the second ring-shaped elastic body are parallel or substantially parallel to a center axis of the sleeve.

17. The jet propulsion device according to claim 1, wherein the first ring-shaped elastic body and the second ring-shaped elastic body are in contact with the impeller housing and the sleeve; and the impeller housing and the sleeve are not in contact with each other.

18. The jet propulsion device according to claim 1, wherein the sleeve is pressed at an outer peripheral surface thereof by the first ring-shaped elastic body and the second ring-shaped elastic body when the sleeve is disposed between the impeller housing and the impeller.

* * * * *